US006035643A

United States Patent [19]

Rosenblatt

[11] Patent Number: 6,035,643

[45] Date of Patent: Mar. 14, 2000

[54] AMBIENT TEMPERATURE SENSITIVE HEAT ENGINE CYCLE

[76] Inventor: Joel H. Rosenblatt, Mile Marker 24.5, Royal Palm Plz., Summerland Key, Fla. 33042

[21] Appl. No.: 09/204,272

[22] Filed: Dec. 3, 1998

[51] Int. Cl.[7] ..... F01K 25/08

[52] U.S. Cl. ..... 60/651; 60/671; 60/682; 60/655

[58] Field of Search ..... 60/645, 651, 655, 60/671, 682

[56] References Cited

U.S. PATENT DOCUMENTS

| | | | |
|---|---|---|---|
| 3,257,806 | 6/1966 | Stahl . | |
| 3,795,103 | 3/1974 | Anderson . | |
| 4,063,419 | 12/1977 | Garrett | 60/671 X |
| 4,424,677 | 1/1984 | Lukasavage . | |
| 4,484,446 | 11/1984 | Goldsberry | 60/651 X |
| 4,542,625 | 9/1985 | Bronicki . | |
| 5,400,598 | 3/1995 | Moritz et al. | 60/651 X |
| 5,437,157 | 8/1995 | Bronicki . | |
| 5,555,731 | 9/1996 | Rosenblatt . | |
| 5,570,579 | 11/1996 | Larjola . | |
| 5,640,842 | 6/1997 | Bronicki . | |

*Primary Examiner*—Hoang Nguyen
*Attorney, Agent, or Firm*—Jacobson, Price, Holman & Stern, PLLC

[57] ABSTRACT

A control system capable of responding to temperature sensors detecting changes in available external ambient cooling temperature, and adjusting turbine cycle thermodynamic medium exhaust pressure and temperature, as it completes its circulation path through the turbine cycle, to what best saturation pressure conditions are needed to correspond with the temperature detected as the coldest currently available saturation temperature in the condenser. Such a system permits condensation of the exhaust to occur at whatever the lowest saturation temperature and pressure available at the time happens to be.

18 Claims, 1 Drawing Sheet

AMBIENT TEMPERATURE SENSITIVE HEAT ENGINE CYCLE

FIELD OF THE INVENTION

This invention relates to a heat engine cycle which enables maximum access to the entire annually available external ambient temperature range, method for carrying out the same and its application as a bottoming cycle in a combined engine cycle application.

BACKGROUND OF THE INVENTION

All heat engine cycles are inherently limited in maximum theoretical efficiency of conversion of the heat energy content of the external heat energy source supplied, to output shaft power delivered, by the maximum external thermal temperature gradient across which the engine cycle operates. That becomes the temperature range between the peak temperature of the external energy source input to the engine cycle, and the minimum external ambient temperature available to which its exhaust stream may be discharged. The greater the difference in temperature between the external heat energy source and the external ambient temperature, the higher the efficiency.

This maximum potential thermodynamic efficiency of all heat engine cycles is known as the "Carnot cycle" efficiency. The Carnot cycle is a hypothetical thermodynamic cycle containing zero internal sources of energy losses, requiring only infinitely small approach temperature differences for heat energy transfer to occur. The Carnot Cycle efficiency is governed by the equation:

$$\text{Carnot Efficiency} = \frac{H.S.(^0K) - C.S.(^0K)}{H.S.(^0K)} \times 10^2$$

wherein H.S.(° K.) is the temperature of the heat source and C.S. (° K.) is the temperature of the cooling source.

Ambient temperatures vary across both a daily and seasonal range. In most areas of the north temperate zone, and at higher altitudes not mitigated by abutting large bodies of water, daily temperature swings of more than 30° F. (16.70° C.) are common, and below- freezing temperatures are seasonally common from late fall through early spring.

Current practice in power plant installations devoted to generation of electric power for distribution, supplied from an external heat energy source at an elevated temperature produced by burning a fuel of one sort or another, overwhelmingly employ steam as the thermodynamic medium circulating in closed Rankine cycle turbine systems. Efforts to improve efficiency have therefore been concentrated on means of developing the maximum peak temperature of the external energy source supplying the turbine cycle. For the site of a given installation, it has been customary to select the coldest reliable naturally available ambient heat sink to serve the system, and adapt the remainder of the cycle to make best use of whatever portion of that naturally occurring ambient sink temperature as could be effectively used by the steam cycle, and as would remain reliably available year round. However, anything colder than the saturation temperature of steam at a minimal saturation pressure of 1.5" hg.abs. offers little further thermodynamic cycle efficiency improvement potential. The use of 1.0" hg.abs. vacuum conditions to circumvent this problem only compound in-leakage problems and add only a small fraction of the winter time opportunity presented.

Another way to circumvent this inherent limitation of steam as a thermodynamic medium circulating in Rankine cycle engines is through the use of organic fluid media in Rankine engine "bottoming cycles" known as "organic Rankine cycles" (ORCs) to permit development of colder available ambient temperature sinks. Such cycles are used in "combined cycle turbine systems" in which steam is also employed to take advantage of the higher temperatures available from external heat energy sources in common use, and the exhaust temperature reached, after the steam portion of the combined cycle thermal range has been traversed, is transferred to the organic fluid medium for continued expansion down to the coolest ambient sink temperature reliably available year round. U.S. Pat. No. 3,257,806 (the "Stahl patent") discloses an example of a system which employs such a combined organic cycle system.

By choosing from among a range of organic hydrocarbon fluids available, appropriate selections for their use as turbine media, for specific thermal regimens anticipated in an application, permits optimizing their selection for a combination of most useful temperatures and pressures for a proposed cycle at its intended site, including use of whatever lowest available ambient temperature sink might exist there to serve the attainable exhaust discharge pressure as saturation pressure at that coldest available ambient temperature. Media, bracketing the thermal range associated with desired temperature and pressure cycle parameters, may be selected not only for their characteristic pressure/temperature curve relationships, but for the shape of their saturation curves across that range to be advantageously chosen to facilitate selection of cycle paths with minimum entropy values.

In U.S. Pat. No. 5,555,731 (the "Rosenblatt patent"), the content of which is expressly incorporated herein in its entirety by reference, the use of an elevated temperature injection cycle is disclosed as part of a combined power turbine system employing an absorption refrigeration subsystem. Such an injection cycle is used for introducing selected mass flow quantities of turbine medium, at a selected temperature, pressure, and quality, into whatever vapor phase condition in the turbine medium exists at the point of injection chosen. In that process, the injected mass flow, pressure, temperature, and quality may all be selected by the cycle designer. The interaction of that additional mass flow, mixing with the vapor medium in transit, may be chosen to alter temperature, pressure, unit volume, and mass flow along the cycle path beyond the point of injection. In addition, the isentropic path along which the ensuing cycle proceeds from the point of injection, is altered.

The original objective of the Rosenblatt patent was directed toward employing that path control property using injectors so as to minimize the presence of superheat waste heat contributions remaining in the isentropic path as saturation pressure developed at a selected pre- determined condenser temperature value. The Rosenblatt patent however failed to give any consideration to the use of the control property to accommodate seasonal changes in temperature. Specifically, the Rosenblatt patent did not take into consideration changes in the external ambient coolant fluid temperature and how by monitoring such a temperature and subsequently altering the temperature, pressure, unit volume, and mass flow along the cycle path beyond the point of injection, access to the entire annually available external ambient thermal range is maximized in the thermodynamic cycle of a Rankine cycle turbine system is made available.

It is therefore an object of the present invention to provide a heat engine cycle for use in a power turbine engine system which is capable of adapting to changes in external ambient temperature.

It is a further object of the present invention to provide a thermodynamic cycle of a Rankine cycle turbine system which is capable of maximizing access to the entire annually available external ambient thermal range.

It is also a further object of the present invention to provide a bottoming cycle in which the exhaust saturation pressure and temperature conditions of the exhaust are adjusted to match the coldest ambient cooling temperature concurrently available, as it occurs.

It is also an object of the present invention to provide an improvement over the power turbine engine system described in U.S. Pat. No. 5,555,731, whereby the system can be adjusted to accommodate changes in external ambient temperature and in which vacuum conditions in the turbine cycle are eliminated.

SUMMARY OF THE INVENTION

The present invention may be accomplished by providing a control system capable of responding to temperature sensors detecting changes in available external ambient cooling temperature, and adjusting turbine cycle thermodynamic medium exhaust pressure and temperature, as it completes its circulation path through the turbine cycle, to what best saturation pressure conditions are needed to correspond with the temperature detected as the coldest currently available saturation temperature in the condenser. Such a system permits condensation of the exhaust to occur at whatever the lowest saturation temperature and pressure available at the time happens to be.

By the present invention and in conjunction with use of the injection turbine concept described in U.S. Pat. No. 5,555,731, the selected mass flow of turbine medium introduced in the turbine cycle path being traversed may be chosen to effect whatever changes are commensurate with establishing the pressure and temperature changes needed to match final exhaust saturation pressure with the temperature at which ambient cooling concurrently available can effect condensation across a minimum reliable approach difference of the temperatures of the two fluids in heat exchange communication in the condenser.

By use of sensors detecting the lowest reliable ambient temperature coolant fluid available in the condenser as it occurs, and adapting concurrent turbine cycle operating parameters to take fill advantage of its existence while it exists, the maximum potential thermodynamic efficiency available may become the actual efficiency in practice during which the cycle is being operated all year long-including the year round diurnal and seasonal fluctuations in ambient temperature conditions as they occur. Other parameter changes in the system may also be detected by sensors with the concurrent adaption of turbine cycle operating conditions as may be necessary under the load and condenser temperature conditions currently in effect.

According to the present invention it is also possible to eliminate the use of vacuum conditions in the turbine cycle.

DESCRIPTION OF PREFERRED EMBODIMENTS

Figure 1:
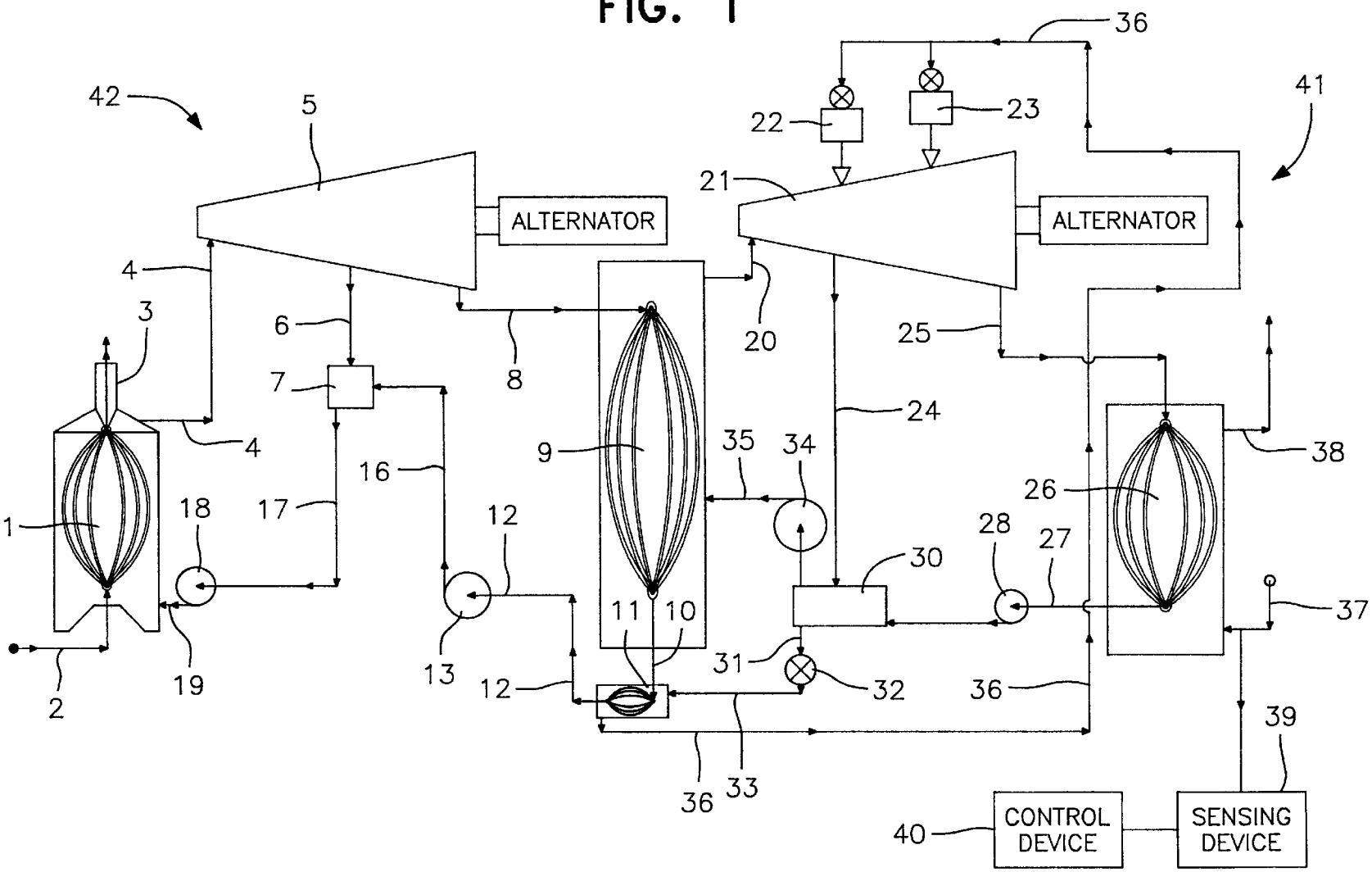
FIG. 1 illustrates a system in accordance with the present invention, the arrangement of which makes it possible to maximize access to the entire annually available external ambient thermal range in a combined cycle application.

The present invention is described by way of reference to its use in a combined cycle application, in particular in combination with a low-pressure steam Rankine cycle turbine system. It is not intended that the scope of the invention be limited to only such applications. However, given the prospect of a bottoming cycle operating below the pressure and temperature range transited by the low-pressure steam turbine, a further opportunity to improve the entire combined cycle facility presents itself. Selection of the pressure and temperature conditions at which to effect the change-over from a steam turbine cycle to ORC bottoming cycle may be made to optimize incremental benefits receivable from each.

In the combined cycle application, the boiler of the bottoming cycle becomes the above-ambient pressure condenser for the low pressure steam turbine cycle. The condenser supplied with ambient cooling fluid becomes the condenser for the new ORC bottoming cycle, still operating at above ambient pressure.

With reference to the drawings, FIG. 1 illustrates a possible configuration of the principal hardware components comprising a system embodying the operating mechanisms to effect the benefits described. It is noted however that variations in componentry may be made and would be within the ambit of a person skilled in the art. The left half of the diagram illustrates the components of a conventional low pressure regenerative Rankine steam turbine system 42. Unlike conventional systems of the type, this one does not expand its contents to a high vacuum exhaust pressure. Its exhaust terminates at a pressure above ambient where it becomes the external heat input supply to the ensuing combined organic Rankine turbine bottoming cycle 41 (whose components are illustrated on the right side of the diagram.) Vessel 9 serves as condenser for the steam turbine cycle and boiler for the ORC (organic Rankine cycle) bottoming cycle 41.

An external high temperature energy heat source is supplied to steam boiler 1 via conduit 2, and its spent gases exit stack 3. The source of that external heat supply may be combustion products resulting from burning a fuel, the exhaust of an associated gas turbine, or even the heat output originating in a nuclear reactor. Generally, the peak temperature of what are categorized as "low pressure steam turbines" is in the neighborhood of 600° F. (315° C.). Steam at such a temperature and elevated pressure exits boiler 1 via conduit 4 to enter steam turbine 5. Steam turbine 5 houses a conventional regenerative Rankine steam turbine cycle, and is equipped with all the internal hardware components conventionally installed in such turbines including admission throttle controls, successive stages of nozzles and blading, extraction belts at which a portion of the flow may be removed, etc. As the steam proceeds along an isentropic path through the turbine, its pressure and temperature fall, its volume expands, and accompanying those state condition changes, the heat energy content it had is converted to mechanical energy driving the blading to create rotating shaft power which drives the alternator shown as the load on the shaft. The alternator delivers output electric power to the transmission line serving the users.

In this application, the steam is expanded only down to ambient pressure at exhaust. Exhaust steam, at that pressure, (and at a saturation temperature in the vicinity of 220° F. (104° C.)), exits turbine 5 via conduit 8 to enter its condenser vessel 9. An extraction point has b shown at conduit 6 supplying boiler feed water heater 7 in accordance with conventional regenerative Rankine cycle practice. Hot water steam condensate formed in condenser 9 exits via conduit 10 to supply input heat in heat exchange communication with counter flowing ORC turbine liquid phase medium in injector supply heater 11. The condensate exits heater 11 via conduit 12 to condensate return pump 13. Condensate return pump 13 elevates the pressure of the feed water return to that of the pressure at which feed water heater 7 is operated. The condensate leaves pump 13 via conduit 16 to mix with the vapor extracted from the turbine and supplied to feed water heater 7, and the ensuing mixxtre leaves the heater via conduit 17 to boiler feed water pump 18. Pump 18 elevates the pressure to the intended operating pressure of boiler 1 and supplies it to the boiler via conduit 19 to repeat the steam turbine cycle.

Steam condenser 9 also serves as the boiler for the ORC bottoming cycle. As steam condenses therein, in heat exchange communication with high pressure liquid phase ORC turbine medium, the heat content from the steam exhaust is transferred to the ORC turbine medium, raising its temperature and vaporizing its phase. The organic turbine medium, at elevated temperature and pressure and in its vapor phase, exits vessel 9 via conduit 20 to enter ORC turbine 21. ORC turbine 21 contains conventional hardware components of a conventional Rankine cycle turbine, for example, admission throttle control, successive stages of nozzles and blading, extraction belt, etc. the construction and arrangement of which would be determined by the design of the system, and is also equipped with inlet injectors at various locations along its cycle path. As the organic vapor expands through the turbine, its pressure and temperature drop, heat energy is transformed to mechanical energy driving the shaft, and the shaft power drives the alternator shown to deliver output electrical power to the distribution system. In transit along its cycle path through the turbine, the organic fluid medium stream also receives additional amounts of supplemental organic fluid medium via valve-controlled injectors 22 and 23 located along its travel path through the staging. The total mass flow arrives as its exit conduit 25 at the saturation pressure and temperature for the organic fluid employed as the turbine medium, a minimum approach difference above the temperature established in condenser 26 by the temperature of the supply of ambient external cooling fluid to the condenser via conduit 37. Spent ambient coolant is returned to the cooling tower or other ambient coolant source via conduit 38.

The condensate organic fluid, now in its liquid phase, exits condenser 26 via conduit 27 to condensate return pump 28 where it is pumped to the pressure of feed stream heater 30, the pressure at which feed stream heater 30 was supplied with extraction vapor from the ORC turbine via conduit 24. The mixture formed in feed stream heater 30, at its temperature and pressure, exits heater 30 via conduit 31. En route to boiler feed pump 34, a portion of the flow is separated from conduit 31 via valved connection 32 to supply the injector system heater via conduit 33. The remainder enters boiler feed pump 34 to be raised to the operating pressure of ORC boiler 9. It enters boiler 9 via conduit 35 to repeat the ORC turbine cycle.

The portion of the ORC liquid phase feed stream return that was split off from conduit 31 via valve 32 is supplied via conduit 33 to injector supply heater 11 in heat exchange communication with the hot water condensate return to the steam turbine cycle. The heated liquid phase organic fluid medium exits heater 11 via conduit 36. Conduit 36 becomes the injector supply manifold feeding injectors 22 and 23.

ORC cycle condenser 26 is being supplied by the coldest ambient coolant source available at the site via conduit 37, and the spent coolant fluid is returned to its source via conduit 38. Its actual temperature at any particular time of the year is diurnally and seasonally variable. As that temperature drops, the lowest saturation pressure and temperature at a minimum approach difference above it falls. To effect a corresponding change in exit pressure from the turbine exhaust to match that temperature, the mass flow through the turbine cycle can be varied by adjustment of the amount of mass flow in the cycle traversing the turbine path introduced via injectors 22 and 23 by virtue of their location along the expansion path and the staging between those locations and the exit. Should that condenser temperature rise, a corollary injector flow adjustment is made to raise the exit saturation pressure and temperature.

Since the rotational speed must remain unchanged from its synchronous speed established by the governor, changes in mass flow are accompanied by changes in exit temperature and pressure as a result of an altered mass flow of medium passing through the same sets of staging which determine the sequence of spatial volume through which the flow passes. Their physical dimensions are built into the hardware in the turbine which produces the sequence of changes in pressures and unit volumes transited during the expansion process of the turbine cycle.

Combined effects of cooling temperature availability and concurrent load demand furnish the set of cycle parameter control device signals to adjust the operating cycle to match those conditions with best efficiency path conditions. Control signals provided by temperature and pressure sensors supply a running feed-back system to assure that the control effect combination instituted matches the cooling water temperature as it occurs, and to operate the controls enabling the adjustments to follow the temperature by appropriate adaptation of the discharge pressure delivered to the condenser within pre-established increments of intended range tolerance.

In use, a sensing device 39, which may be one or more sensors, is located at the inlet to the condenser 26, within the condenser or along a portion of the conduit 37 such that the lowest temperature of the external cooling fluid is detectable. Once the sensed temperature is determined a series of controls are effected and a determination is made as to which of the necessary parameters must be altered so that the exit pressure and temperature produce selected saturation properties for the medium that closely approximate the coldest condensation temperature sensed and made available by the ambient cooling temperature presently existing in the condenser. One way to effect such a change in parameters is by either reducing or increasing the mass flow of thermodynamic medium as needed to alter the exit pressure and temperature to produce the selected saturation properties. In FIG. 1, valve controlled injectors 22 and 23 are used to alter mass flow; however other parameters may be altered by different means to acheive the same results as will become apparent from the description which follows.

The means of controlling the mass flow may be via an automated system or may be effected manually. As shown in FIG. 1, a control device 40 is connected to the sensing device and, in an automated system would adjust the mass flow through injectors 22 and 23 with operationally responsive valve control means modifying the mass flow injected during operation. Mass flow may also be altered by throttle admission at various points along the cycle path, one example being at the entrance to the ORC turbine. It is considered that any means for altering mass flow conditions may be used so long as it assures the arrival of the media at the condenser entry in the most appropriate thermodynamic state conditions of temperature and pressure to facilitate occurrence of condensation at the lowest possible temperature available from the external cooling fluid. Sensors for sensing various other parameters may also be used such as sensors for detecting changes in pressure, temperature, velocity, speed of rotation, delivered electrical output power, voltage, current and frequency so as to enable the system to be brought into conformance with intended operating parameters of the cycle under the load and condenser temperature conditions currently in effect.

Selection of the sequence of internal pressure changes and flow velocities is accomplished by the number and types of staging sequences built into the hardware of the turbine components. The staging creates the sequence of cycle thermodynamic parameters that produce the operating conditions desired along the expansion path. Even removal of a portion of the medium from the flow path at intermediate locations (via extraction belts along the route), which remove quantities of vapor via conduit piping leaving the turbine, is part of the condition assumptions of the component hardware detailing planned. All such flow path modifications must be accomplished with no change occurring in the synchronous rotational speed of the shaft, to maintain frequency stability of the alternating current output from the alternator being driven.

Prior to the present invention, the design path exit assumed a predetermined design saturation pressure and temperature at which exit conditions developed by the cycle would permit condensation. The engineering methodology for designing and building hardware details of the nozzles, blade shapes, number of stages, provision of bleed belts, and controlling path lengths to create desired cycle conditions along that path is common and well-known in the art.

As a result of allowed moisture content of the exhaust, as the expansion path crosses the saturation curve, a substantial volume change of the mass flow of the medium occurs, in turn effecting variations in pressure and velocity. In passing from vapor to liquid phase near exhaust pressures, the volume of the fluid medium decreases by orders of magnitude at constant pressure. Development of limited moisture content in the turbine exhaust, to the extent that it was a part of the design intent of the selected cycle, decreases the volume occupied by the same mass flow (and thereby the pressure at constant temperature or the velocity along the traveled channel). Tolerance for development of that condition is constrained by the risk of some loss of efficiency due to impact of moisture particles on the backs of the blading, and risk of undue wear and damage to the blading if it exceeds design allowances. These adverse effects are far less when dealing with the less dense hydrocarbon media than they are dealing with steam.

When the injector system of the present invention is used for the control of mass flow path conditions the liquid phase medium supplied to the injectors is being injected into the vapor flow path from an elevated temperature and pressure supply. The medium may also be flashed to the reduced entry pressure at the point of injection through the injector nozzle, to admit the new mass flow addition in a selected phase state to contain whatever percent moisture content is most appropriate to formation of its mixture with the vapor flow in transit best suited to creation of the desired state conditions that will produce the intended sequence of flow transitions along the ensuing cycle path from the point(s) of injection.

Throttle admission controls may be used to adapt the fluid mix to variation in load demand by controlling the proportion of mass flow originating in the initially admitted elevated temperature vapor phase medium. Extraction points remain means for altering turbine medium mass flow between admission quantities and exhaust quantities to match a more substantive desired pressure change condition at exhaust. The use of the injection system provides the ability to increase or reduce selectable mass flow amounts of turbine medium mass flow in the stream incrementally, at whatever points along the path a cycle designer selects, to effect whatever combination of pressure, temperature, and volume state conditions create optimum conditions for minimum saturation temperature and pressure to exist at exhaust discharge conditions most advantageously compatible with whatever coldest condenser temperature is present at the time.

Among the continuously controllable flow variables, monitored continuously by sensors placed at strategic locations in the cycle path, it becomes possible to program an automated control system to maintain optimized relationships of state conditions of the thermodynamic medium flowing through the cycle detected by the sensors, and delivering control signals to servo-operated valves supplying the injector nozzles, in response to variation in external conditions not within control of plant operators (variations in the ambient temperature). The control system becomes an on-line "fine tuning" system. It may even permit initial "fine-tuning" for variations resulting from interactions of original variation in manufacturing tolerances when components are initially assembled (even after following a selective tolerance component assembly procedure).

More significant reduction changes, bracketing a pressure range beyond the sum of incremental adjustment capability of the injectors, may be sequentially instituted by a set of major mass flow changes by provision of means of opening or by-passing a significant mass flow of vapor altering flow of extraction vapor to supply feed stream heater 30 before it reaches the condenser. Significant increases in mass flow vapor volume may be introduced via a combination of mass flow injection at the injectors and opening the principle admission throttle.

Feed stream heating does not result in waste heat being discharged externally from the cycle at a cost of reduced thermodynamic efficiency. Provision of a feed-stream heater extraction point has been illustrated at the location of conduit connection 24.

Such details, built into physical components of Rankine cycle turbines when they are designed, have been built to respond to anticipated changes in daily demand load cycle rather than to follow variations in short term ambient temperature fluctuations. Many are left to operating personnel to institute as demand suggests by operation of throttling controls installed for the purpose on the turbine. Cooling water pumping rate control has been the principle response to changes in cooling water temperature. That does not alter the efficiency of the thermodynamic cycle operating. It changes parasitic plant power demand. Only a minimal capability exists to further increase the vacuum level in the condenser to take advantage of substantive lowering of ambient cooling fluid temperatures becoming occasionally available.

In conjunction with use of an ORC bottoming cycle conjoined with a conventional steam turbine cycle in a combined cycle system, further opportunity is created to permit the combined cycle system to be designed with complete recognition that the steam turbine portion will be operated within its throttle constraints along the same cycle path at all times. In accordance with the above described combined cycle application shown in FIG. 1, the low pressure steam turbine cycle will always be operating between about 600° F. (315.5° C.) and 225° F. (107° C.) ambient pressure exhaust, if that were selected as the cross-over pressure. That leaves the combined cycle ORC turbine bottoming cycle as the only one to be equipped with special details for controlling its cycle to respond to variations in exhaust temperature conditions. While its peak input temperature will always remain about 220° F. (104° C.), its exhaust temperature may vary from perhaps 950° F. (35° C.) down to perhaps 100° F. (−12° C.) or lower, depending on site parameters. The steam turbine cycle will always transit a greater thermal range than the ORC cycle if cross-over be chosen at minimum ambient pressure.

For reasons of optimizing blading, manufacturing economics, distribution of the share of total demand load between the two turbines, or other hardware reasons, selection of a higher pressure cross-over point may offer additional improvement benefits. Selection might also be made based on how far back up the expansion path best locations for instituting injection control might be to obtain best response to adjustments made. The benefits of total vacuum condition elimination will have been realized at any higher pressure steam exhaust than ambient, and whatever saturation pressure is selected for the cross-over point will fix the year round temperature gradient across which the steam turbine cycle portion of the combined cycle remains constant year round.

While description of feasible minute adaptations to minor changes in ambient temperature variations have been indicated, including its potential for complete automation control, pragmatically, the concept need not be micro metrically and instantaneously sensitive in response to effect most of the benefits described. With no effort at automation at all, the system may be manually controlled via a simple read-out of sensor conditions on the operator's control panel in the plant enough to permit an operator to institute adjustments to keep the readings within pre-established limits for a discreetly pre-selected set of external ambient temperature range segments. In many installations, most of the benefits of ambient tracking can probably be realized by little more than seasonal adjustments, and day-and-night settings, at pre-established dates and times, or for pre-determined finite segments of historical ambient temperature range occurrences.

A few simple valve settings every three months, and each morning and evening, may effect more than ninety percent of the projected efficiency improvement the potential for ambient tracking offers. Ignoring the small incremental additional efficiency potential offered by infrequent occurrence of a few days a year of −15° F. weather (−26° C.), might permit the entire exhaust end of the ORC turbine to be designed to make beneficial use of everything down to perhaps the average mid-winter night-time saturation temperature as its lowest useable exhaust temperature all winter long- even in most of the coldest winter areas of the country. The reduced precision of the match might scarcely result in an economically accountable loss in annual average operating efficiency. Keeping the cycle operating within a ten-degree minimum approach difference tolerance in exhaust temperature may very well assure peak reliability and operational simplicity of far greater benefit than efforts to maintain the absolute minimum approach difference between exhaust temperature and whatever coldest instantaneous ambient cooling fluid temperature might exist, in micro metric increments, for only rare or transient occurrences.

Typically, low pressure steam turbines today operate across the temperature range of about 600° F. (315° C.) to saturation temperature at 1.5" hg.abs. exhaust pressure-approximately 92° F. (33° C.). That offers a maximum potential Carnot cycle efficiency of 48.4%. Their cycles are generally designed to achieve the same maximum peak efficiency for all temperatures during the year in which the available condenser cooling is everything from 850° F. (29.4° C.) down.

An opportunity to take advantage of ability to use a 40° F. (44° C.) exhaust only 50% of the operating hours per year makes access to a 52.8% maximum potential efficiency available for half the annual total, i.e.—a 4.5% average annual efficiency increase. In many parts of the country, in summer, steam turbine plants cannot achieve the 1.5" hg.abs. vacuum conditions on which their name-plate ratings are based, and power plants actually have a differing "winter rating" and "summer rating" for their "firm power" contribution to the system. In many places, access to below-zero temperatures all winter long offers no increased opportunity for thermodynamic cycle improvement. The improvements cited as available to the proposed new system are additive to benefits of eliminating existing losses that regularly occur in the operating experience of dealing with steam power plants.

While the primary objective of the invention as it applies to combined cycles is the opportunity to extend the thermal gradient across the total pair of cycles being combined, to access the limit of the full temperature range available between external high temperature heat energy source and external low temperature available ambient sink (to maximize potential thermodynamic efficiency), additional benefits also become available to get rid of many difficulties that exist in operation of conventional steam turbine cycles today. These have been inherited from an era when ability to get them to reach as low a temperature as possible, within the constraints of use of steam, drove them to accept and develop high vacuum exhaust conditions.

The on-going operational difficulties of maintaining high vacuum conditions in steam condensers mentioned above (control of in-leakage of air, long blade lengths in bottom stages, removal of in-leakage of air via steam eductors, and continuous quality control of boiler feed water to eliminate entry of injurious materials in addition to dissolved oxygen itself) may be completely avoided- by selection of the steam-to-ORC cross-over point to occur at a pressure above atmospheric.

When the steam turbine cycle portion of the combined cycle is terminated at a pressure just above the highest ambient air pressure likely to occur at an installation, all vacuum condenser conditions in the plant may be eliminated. The entire cycle path in the organic Rankine bottoming cycle can be selected to be above ambient pressure at its lowest intended exhaust temperature. Not only are all the disadvantages of the dissolved oxygen content of boiler feed water eliminated from the steam turbine cycle, but perhaps many of those contaminants requiring frequent boiler blowdown operations to maintain proper boiler conditions, and other plant loss sources involved in the need to operate steam eductors to maintain vacuum levels and remove non-condensibles from the condenser. The cross-over point selection simply replaces the thermal gradient across the low pressure end of the steam turbine cycle with an elevated pressure top end of the ensuing ORC turbine cycle transiting the same combined external thermal range across both. Neither need transit a below-ambient pressure condition.

The thermodynamic medium circulating through the organic rankine cycle (ORC) will be any organic medium suitable for the designed system, the choice of which will be determined by the requirements of the system. Examples of thermodynamic medium suitable for the system of the present invention include, but are not limited to, isobutane isobutylene, 1-butene, trans 2-butene, cis 2-butene and 1-butyne. An example of a suitable coolant fluid is water.

As mentioned above, the use of the thermodynamic cycle system of the present invention is not limited to use in combination with a low-pressure steam rankine cycle turbine system as described in the drawings. The thermodynamic cycle may be used in combination with a low temperature engine system such as the one described in U.S. Pat. No. 4,503,682, expressly incorporated herein by reference in its entirety. In such a case, the lowered ambient condensate increases the cooling capacity supplied to recover regenerative heat transfer from the absorption refrigeration (AR) sub-system refrigerant condenser thereby increasing the coefficient of performance of the AR sub-system and the thermodynamic efficiency of the ambient ORC system.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. An organic Rankine bottoming cycle system for use in a power turbine system comprising:

a circulating thermodynamic medium;

a boiler which receives an external heat energy source and which receives the circulating thermodynamic medium such that said external heat energy source and said circulating thermodynamic medium received are in heat exchange communication effecting heating and vaporization of the thermodynamic medium;

an organic rankine turbine having an inlet for receiving the heated thermodynamic medium from the boiler in its mixed or vapor phase, a flow path for travel of the thermodynamic medium therethrough and an outlet for exhausting the thermodynamic medium from the turbine;

a cooling fluid from an external source, said cooling fluid having a temperature which is susceptible to external changes in temperature;

a condenser having a first inlet for receiving the cooling fluid from the external source and a second inlet for receiving the exhausted thermodynamic medium from the turbine, wherein the exhausted medium is in saturation condition at a saturation temperature and a minimum approach difference above the lowest temperature of the cooling fluid; said cooling fluid and said exhausted medium being in heat exchange communication within the condenser such that heat of condensation of the exhausted medium is removed to create a liquid phase condensate at a saturation temperature approximating the minimum reliable approach difference above the lowest temperature of the coolant fluid;

a feed stream return path connected to the condensor for delivering the liquid phase condensate from the condenser to the boiler to repeat the cycle; and a system for controlling the saturation temperature and pressure of the exhausted medium responsive to changes in temperature of the cooling fluid to thereby ensure that the saturation conditions of the exhausted medium is such that it permits condensation at the lowest available temperature of the cooling fluid.

2. The system of claim 1, wherein the system for controlling the saturation pressure and temperature of the thermodynamic medium exhausted from the turbine comprises sensing means for sensing changes in temperature of the cooling fluid and mass flow control means which controls the flow of the thermodynamic medium to the turbine.

3. The system of claim 2, wherein the flow of thermodynamic medium to the turbine is automatically controlled in response to the sensed changes in cooling fluid temperature.

4. The system of claim 2, wherein the flow of the thermodynamic media to the turbine is manually controlled in response to sensed changes in cooling fluid temperature.

5. The system of claim 2, wherein the means for controlling the mass flow to the turbine comprises valve controlled injector means which permit the introduction of operationally variable mass flow quantities of liquid, vapor or mixed phase thermodynamic medium into the turbine for mixing with the vapor phase media in transit therethrough, said valve controlled injector means being located along the travel path of the medium through the turbine.

6. The system of claim 5, wherein the valve controlled injector means draw thermodynamic medium from selected points along the feed stream return path.

7. The system of claim 1, further comprising means for programming condition requirements for the system and means for maintaining said programmed condition requirements including a sensing means for sensing the conditions along the cycle path to ensure that the programmed condition requirements are met.

8. The system of claim 1, wherein the external heat source effecting heating and vaporization of the thermodynamic medium in the boiler is derived from a low pressure steam Rankine cycle turbine system in combined cycle relationship with the organic rankine bottoming cycle.

9. The system of claim 8, further comprising the low temperature engine system having steam circulating therethrough and being expanded no further than ambient air pressure thereby eliminating use of vacuum conditions.

10. In an organic Rankine bottoming cycle (ORC) system, a method for improving access to the entire annually available ambient heat sink comprising:

circulating a thermodynamic medium through the ORC system;

providing an external heat energy source and passing said external heat energy source in heat exchange relationship with the circulating thermodynamic medium within a boiler;

transferring heat from the external heat energy source to the circulating thermodynamic medium in the boiler thereby heating and vaporizing the medium;

transferring the heated thermodynamic medium to an organic Rankine turbine in its mixed or vapor phase;

providing a flow path for travel of the thermodynamic medium through the turbine and exhausting the turbine medium from the turbine;

passing a cooling fluid from an external source in heat exchange relationship with the exhausted turbine medium in a condenser, wherein the exhausted turbine medium is in saturation condition at a saturation temperature a minimum approach difference above the lowest temperature of the cooling fluid;

removing heat of condensation of the exhausted turbine medium to create a liquid phase condensate at a saturation temperature approximating the minimum reliable approach difference above the lowest temperature of the coolant fluid;

returning the liquid phase condensate created to the boiler to repeat the cycle via a feed stream return path; and controlling the saturation temperature and pressure of the exhausted turbine medium in response to changes in temperature of the cooling fluid to thereby ensure that the saturation conditions of the exhausted turbine medium is such that it permits condensation at the lowest available temperature of the cooling fluid.

11. The method of claim 10, wherein controlling the saturation pressure and temperature of the thermodynamic medium exhausted from the turbine comprises sensing changes in temperature of the cooling fluid and controlling mass flow of the thermodynamic medium in the turbine.

12. The method of claim 11, further comprising automatically controlling the mass flow of the thermodynamic medium to the turbine in response to the sensed changes in cooling fluid temperature.

13. The method of claim 11, further comprising manually controlling the mass flow of the thermodynamic medium to the turbine in response to sensed changes in cooling fluid temperature.

14. The method of claim 11, wherein controlling the mass flow to the turbine comprises providing valve controlled injector means which permit the introduction of operationally variable mass flow quantities of liquid, vapor or mixed phase thermodynamic medium into the turbine for mixing with the vapor phase medium in transit therethrough, said valve controlled injector means being located along the travel path of the medium through the turbine.

15. The method of claim 14, wherein the valve controlled injector means draw thermodynamic medium from selected points along the feed stream return path.

16. The method of claim 10, further comprising programming condition requirements for the system and maintaining said programmed condition requirements including sensing the conditions along the cycle path to ensure that the programmed condition requirements are met.

17. The method of claim 10, wherein the external heat source effecting heating and vaporization of the thermodynamic medium in the boiler is derived from a low pressure steam Rankine cycle turbine system in combined cycle relationship with the organic rankine bottoming cycle.

18. The method of claim 17, wherein the low temperature engine system has steam circulating therethrough which is expanded no further than ambient air pressure thereby eliminating the use of vacuum conditions.

* * * * *